US009449774B2

(12) United States Patent
De Natale et al.

(10) Patent No.: US 9,449,774 B2
(45) Date of Patent: Sep. 20, 2016

(54) POWER AND CONTROL UNIT FOR A LOW OR MEDIUM VOLTAGE APPARATUS

(75) Inventors: Gabriele Valentino De Natale, Milan (IT); Luciano Di Maio, Milan (IT)

(73) Assignee: ABB TECHNOLOGY AG, Zurich (CH)

( * ) Notice: Subject to any disclaimer, the term of this patent is extended or adjusted under 35 U.S.C. 154(b) by 993 days.

(21) Appl. No.: 13/581,930

(22) PCT Filed: Feb. 22, 2011

(86) PCT No.: PCT/EP2011/052571

§ 371 (c)(1),
(2), (4) Date: Aug. 30, 2012

(87) PCT Pub. No.: WO2011/107372

PCT Pub. Date: Sep. 9, 2011

(65) Prior Publication Data

US 2012/0319476 A1 Dec. 20, 2012

(30) Foreign Application Priority Data

Mar. 5, 2010 (EP) ..... 10155695

(51) Int. Cl.
*H02J 1/00* (2006.01)
*H01H 47/00* (2006.01)

(52) U.S. Cl.
CPC ..... *H01H 47/002* (2013.01); *Y10T 307/313* (2015.04)

(58) Field of Classification Search
CPC ..... H01H 47/002
USPC ..... 307/19
See application file for complete search history.

(56) References Cited

U.S. PATENT DOCUMENTS 6,311,092 B1 * 10/2001 Yamada ..... G11B 20/10527 381/61
2003/0067287 A1 * 4/2003 Morgen ..... G05F 1/465 323/273

(Continued)

FOREIGN PATENT DOCUMENTS

DE 19919729 A1 11/2000
DE 10031467 * 1/2001

(Continued)

OTHER PUBLICATIONS

Notification of the First Office Action issued Jul. 2, 2014 in Chinese Appln No. 201180010472.

*Primary Examiner* — Rexford Barnie
*Assistant Examiner* — Toan Vu
(74) *Attorney, Agent, or Firm* — Polsinelli PC

(57) ABSTRACT

A power and control unit for a low or medium voltage apparatus, said apparatus comprising at least a couple of electrical contacts that can be coupled/separated by means of an electro-magnetic actuator, first power storage means for supplying electric power for the operations of said apparatus and power supply means for charging first said power storage means, characterized in that it comprises:

Figure 1:
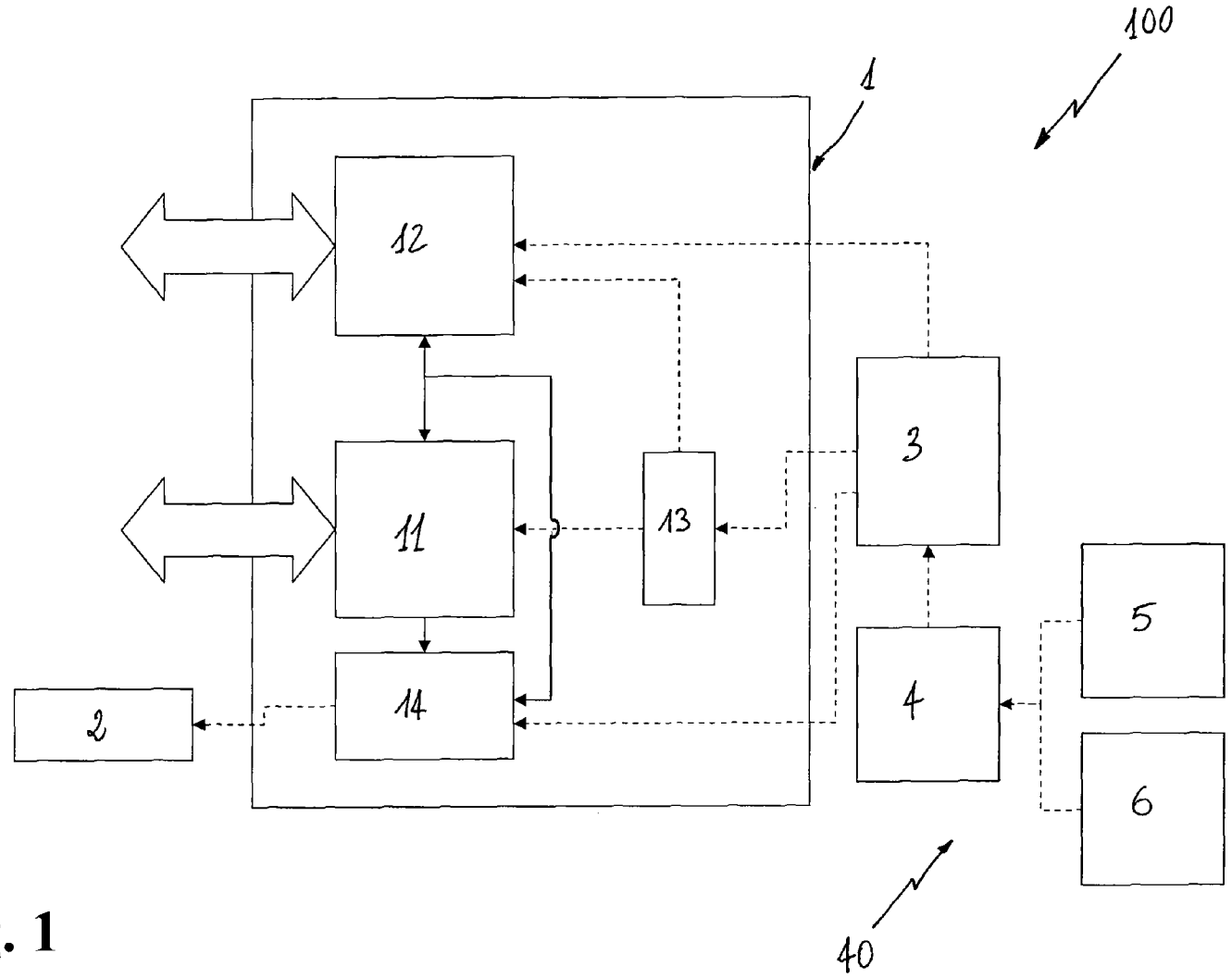

a primary control device for managing the operations of said apparatus when said power supply means are available;

a secondary control device for managing the operations of said apparatus when said power supply means are not available, said secondary control device being able to receive electric power directly from said first power storage means.

19 Claims, 4 Drawing Sheets

(56) References Cited

U.S. PATENT DOCUMENTS

2003/0137786 A1* 7/2003 Hasegawa ..... H02H 9/001 361/10
2005/0067999 A1* 3/2005 Okamura ..... B60L 15/2045 318/800
2006/0176020 A1* 8/2006 Ibrahim ..... H02J 7/0063 320/127
2007/0091080 A1* 4/2007 Ek ..... G06F 1/30 345/204
2007/0115604 A1 5/2007 Zettel et al.
2008/0111517 A1 5/2008 Pfeifer et al.
2009/0067202 A1* 3/2009 Ichikawa ..... B60L 11/1868 363/79
2009/0319110 A1* 12/2009 Tani ..... B60K 6/48 701/22
2010/0039311 A1* 2/2010 Woodington ..... G01S 13/34 342/70

FOREIGN PATENT DOCUMENTS

DE 10031467 A1 1/2002
EP 2149895 A1 2/2010
WO WO 03/040551 A2 5/2003

* cited by examiner

POWER AND CONTROL UNIT FOR A LOW OR MEDIUM VOLTAGE APPARATUS

CROSS REFERENCE TO RELATED APPLICATIONS

This application is a National Phase filing under 35 U.S.C. §371 of PCT/EP2011/052571 filed on Feb. 22, 2011; and this application claims priority to application Ser. No. 10/155,695.9 filed in Europe on Mar. 5, 2010 under 35 U.S.C. §119; the entire contents of all are hereby incorporated by reference.

The present invention relates to a power and control unit for a low or medium voltage apparatus having improved features in terms of performances and functionality.

The power and control unit, according to the invention, is conveniently used in low or medium voltage apparatuses, such as circuit breakers, contactors, disconnectors and the like.

For the purposes of the present application the term "medium voltage" is referred to applications in the range of between 1 and 50 kV and the term "low voltage" is referred to applications in the range below 1 kV.

A further aspect of the present invention relates to a power supply circuit for a power and control unit, which provides improved performances in terms of power dissipation reduction.

As widely known, some low or medium voltage apparatuses available on the market comprise one or more couples of electrical contacts that can be coupled/separated by means of an electro-magnetic actuator.

In an electro-magnetically actuated low or medium voltage apparatus, a capacitor bank is provided for supplying the electrical power needed for operating activities of the apparatus, e.g. for operating the electro-magnetic actuator or supplying the power and control unit.

In normal conditions, such a capacitor bank is continuously charged by an auxiliary power supply that is typically electrically connected to the mains.

In principle, an electro-magnetically actuated apparatus cannot be operated anymore, if the power supply is not available for some reasons, e.g. due to an electrical fault.

In fact, without the continuous charging action offered by the auxiliary power supply, the power stored in the capacitor bank is quickly dissipated by the power and control unit of the apparatus and the capacitor bank is soon no more able to provide sufficient electric power to operate the electro-magnetic actuator.

In the attempt of overcoming this disadvantage, some known electro-magnetically actuated apparatuses comprise power and control units, in which a further capacitor for storing electric power is provided.

Said additional capacitor, which is charged when the apparatus is under normal operating conditions, is able to provide electric power to operate the electro-magnetic actuator for a predefined time, such as for 24 hours since when the auxiliary power supply is lost.

Unfortunately, this solution merely provides an extra time, in which electric power may be still available to operate the electro-magnetic actuator. Once this extra time is passed, the apparatus cannot work anymore.

Further, the actual charging status of the second capacitor is not monitored at all. Therefore, even if an opening operation of the apparatus is commanded, such an operation may be performed in unsafe conditions, since the second capacitor may not have a sufficient residual stored power to operate the electro-magnetic actuator.

It is an object of the present invention to provide a power and control unit for a low or medium voltage apparatus that solves the above-mentioned problems.

More in particular, it is an object of the present invention to provide a power and control unit, which allows a low or medium voltage apparatus to be safely operated even when the auxiliary power supply is no more available.

Yet another object of the present invention is to provide a power and control unit, which allows a low or medium voltage apparatus to be operated for a relatively long time since when the auxiliary power supply is no more available.

Another object of the present invention is to provide a power and control unit, which can be easily manufactured and at competitive costs.

The present invention thus provides a power and control unit for a low or medium voltage apparatus, said apparatus comprising at least a couple of electrical contacts that can be coupled/separated by means of an electro-magnetic actuator, first power storage means for supplying electric power for the operations of the apparatus and power supply means for charging said first power storage means.

The power and control unit, according to the invention comprises two different control devices that are aimed at managing the apparatus operations in normal and in emergency conditions, namely when the power supply means are/are not available.

A primary control device manages the operations of said apparatus when the mentioned power supply means are available.

A secondary control device instead intervenes to manage the operations of the apparatus when the mentioned power supply means are no more available for any reason, e.g. due to an electrical fault.

In order to be powered even if the mentioned power supply means are not available, the secondary control device is able to receive electric power directly from the first power storage means.

The secondary control device is advantageously arranged to provide a reduced set of functionalities and to remarkably reduce the total amount of dissipated power.

If there is still sufficient power in the first power storage means, the secondary control device is advantageously able to stay quiescent for most of the time and periodically perform some emergency activities aimed at ensuring a sufficient level of operativeness of the apparatus.

Therefore, even if the secondary control unit is fed by the first power storage means, in emergency conditions, the power stored in the first power storage means decreases relatively slowly and the residual operating life of the apparatus is remarkably extended (e.g. up to 60 days from the instant in which the auxiliary power supply is lost).

The secondary control device is advantageously able to periodically check the charging status of the first power storage means.

If the power stored in said first power storage means is below a predefined threshold, the secondary control device commands, directly or through the primary control device, an "opening" operation of the apparatus, i.e. an operation, in which the electric contacts of the apparatus are separated.

Therefore, if the power stored in the first power storage means becomes insufficient to operate the electro-magnetic actuator, the apparatus itself is finally set in a safe operative condition, in which the electric contacts are separated.

In this manner, the operations of the apparatus are always managed in safe conditions, i.e. always having a sufficient level of power in the first storage means to operate the electro-magnetic actuator.

In a further aspect, the present invention concerns a power supply circuit a power and control unit.

Said power supply circuit comprises a DC/DC converter, which is electrically connected with a power source, e.g. the mentioned first power storage means, in order to convert a first voltage, provided by said power source, into a second voltage that is lower than said first voltage.

Said DC/DC converter comprises a switching section, which includes a switching device, a driving section and an output section.

The driving section of said DC/DC converter comprises at least a further switching device that is operatively associated to the switching device of the switching section, so as to immediately stop the current flowing in said switching device, when said switching device is commanded to switch off.

Figure 2:
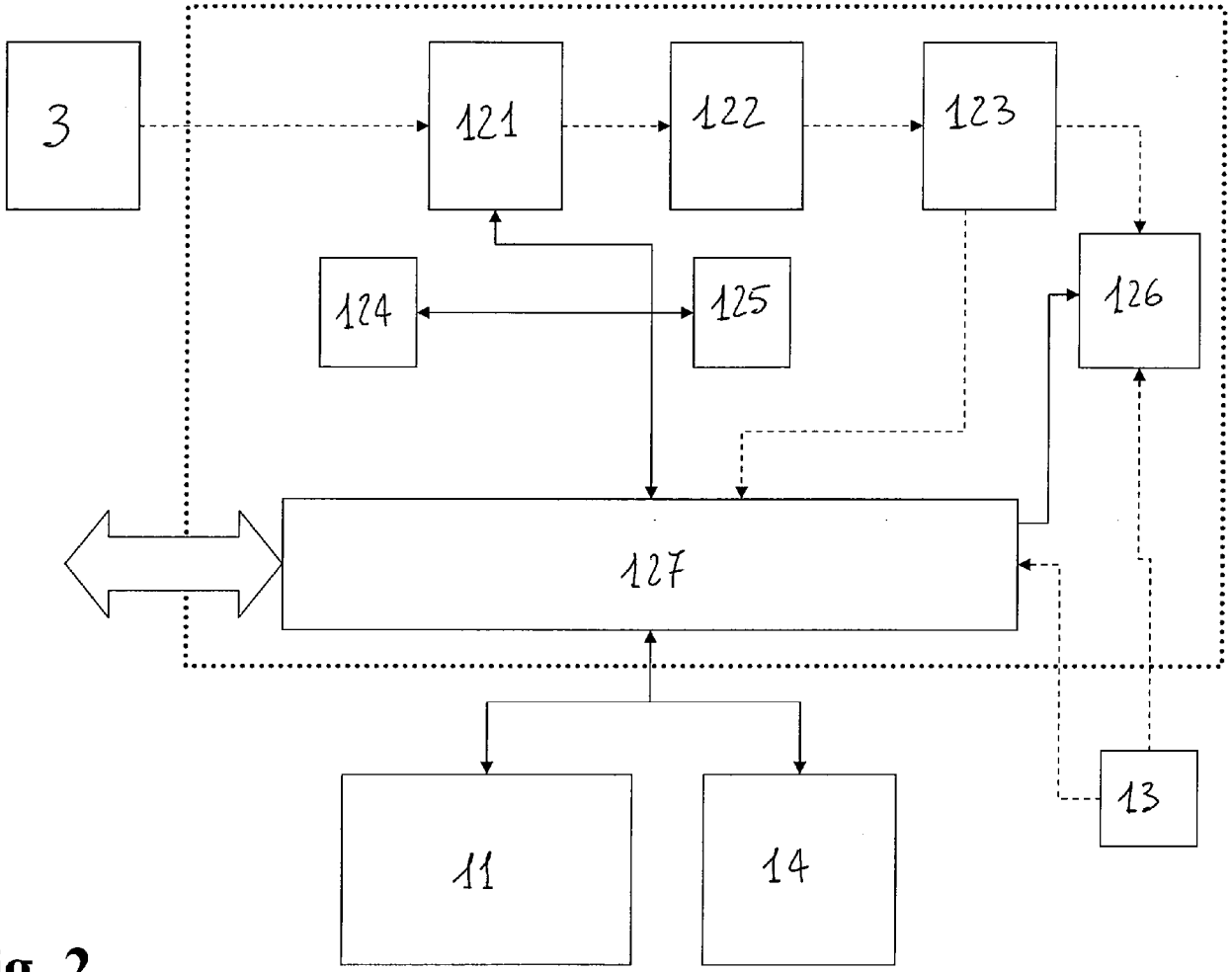
Figure 3:
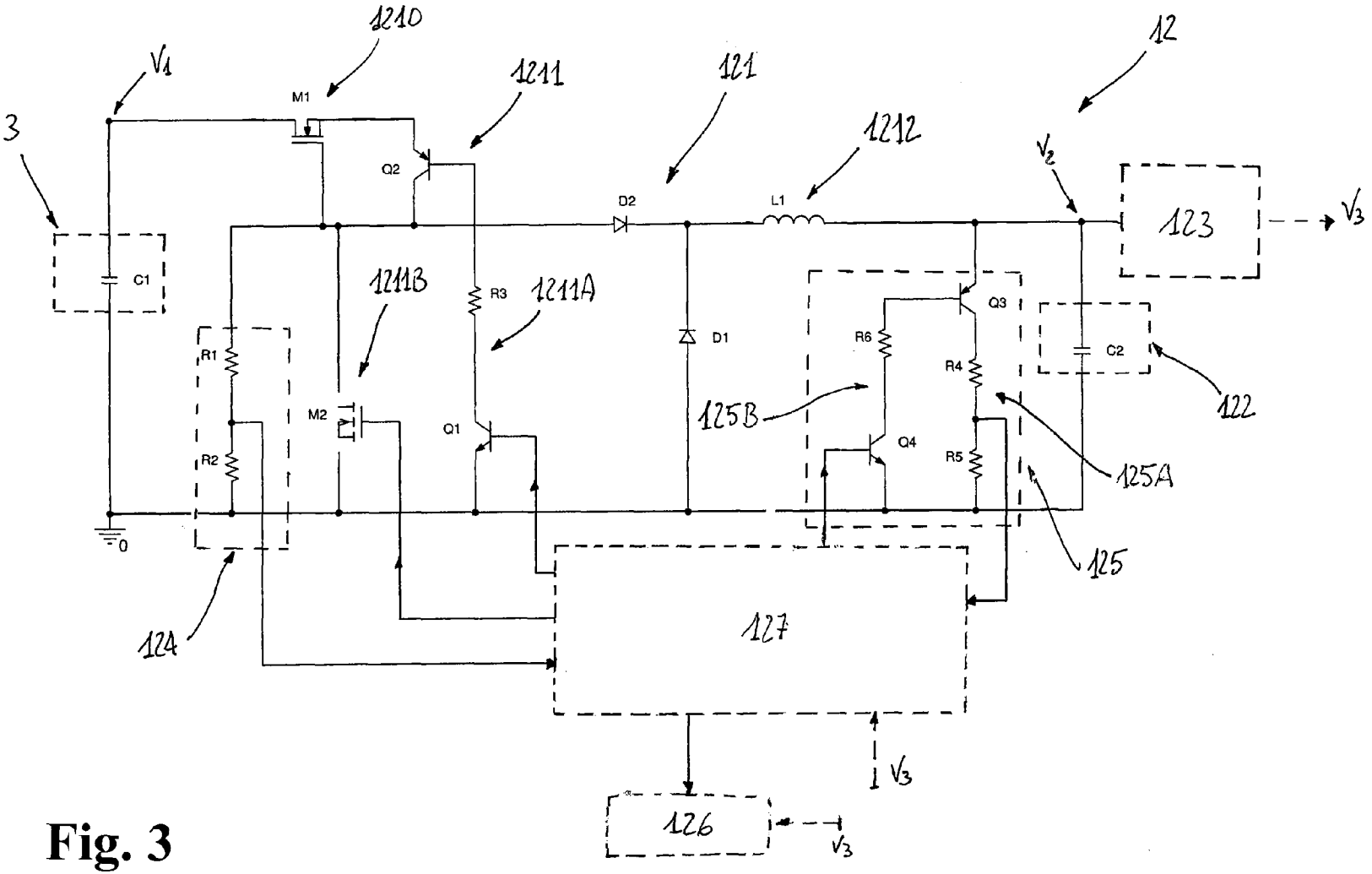
Figure 4:
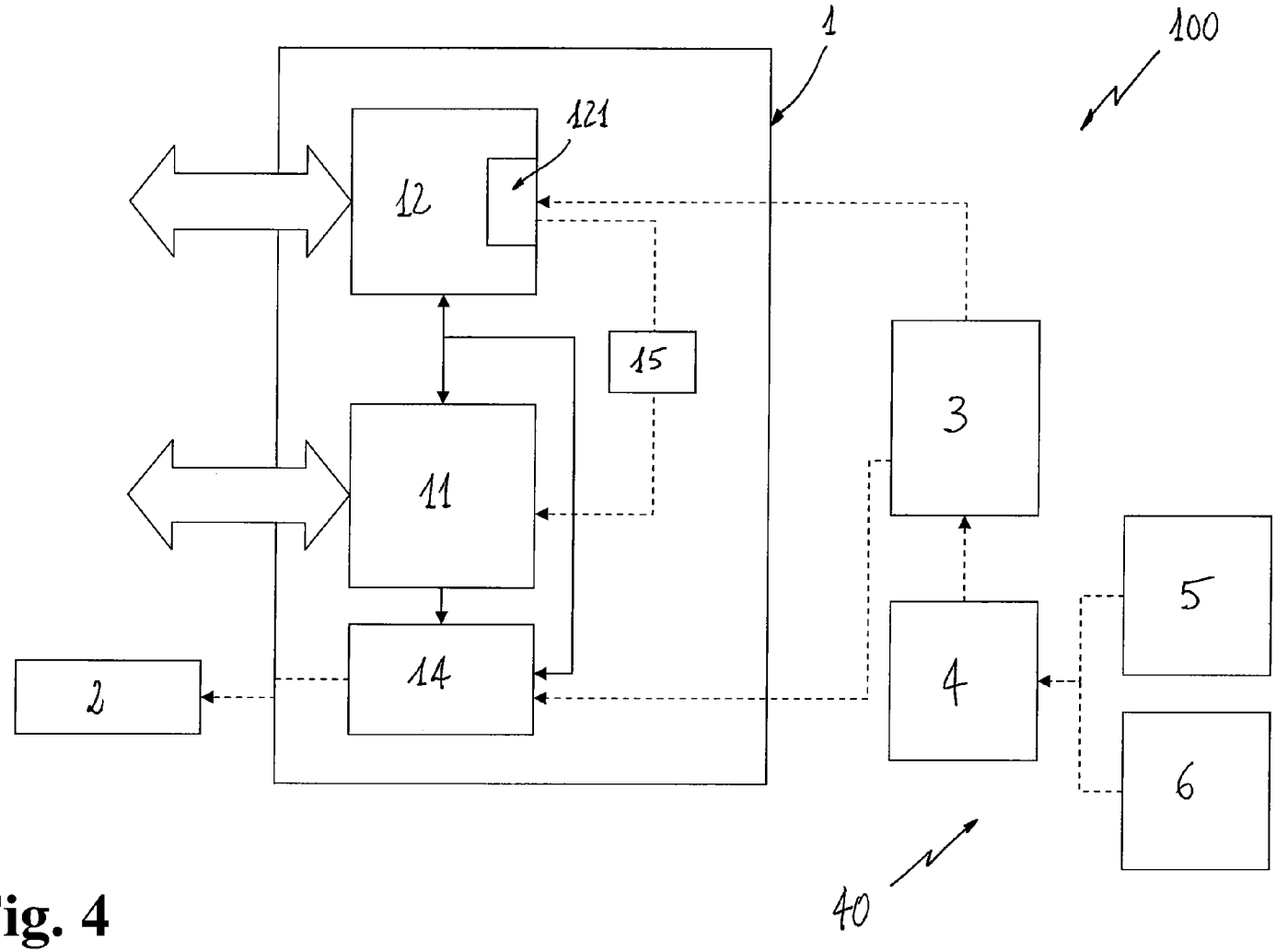

Further characteristics and advantages of the invention will emerge from the description of preferred, but not exclusive, embodiments of the power and control unit for a low or medium voltage apparatus, according to the invention, non-limiting examples of which are provided in the attached drawings, wherein:

FIG. 1 is a block scheme of an embodiment of the power and control unit, according to the invention; and FIG. 2 is a block scheme of the secondary control device in the power and control unit, according to the invention; and FIG. 3 is a partial circuit scheme of the secondary control device in the power and control unit, according to the invention; and FIG. 4 is a block scheme of a further embodiment of the power and control unit, according to the invention.

Referring to the cited figures, the present invention relates to a power and control unit 1 for a low or medium voltage apparatus 100, which is partially shown in FIG. 1.

The apparatus 100 comprises at least a couple of electrical contacts (not shown) that can be coupled/separated by means of an electro-magnetic actuator 2.

The apparatus 100 comprises also first power storage means 3, e.g. a power capacitor C1 (FIG. 3), for supplying electric power for the operations of the apparatus 100.

In the apparatus 100, power supply means 40 for charging the first power storage means 3 are provided.

The power supply means 40 preferably comprise manual power charging means 5 and/or an auxiliary power supply 6 that is electrically connected to the mains.

The power supply means 40 may also comprise a charging circuit 4 through which electric power is delivered to the first power storage means 3.

In normal operating conditions of the apparatus 100, the power supply means 40 continuously charge the first power storage means 3, thus keeping the power stored therein at an optimal level.

The power and control unit 1, according to the invention, comprises a primary control device 11 and a secondary control device 12.

The primary control device 11 is aimed at managing the operations of the apparatus 100 in normal conditions, when the power supply means 40 are available, i.e. they are able to provide electric power to the apparatus 100.

The secondary control device 12 is instead aimed at managing the operations of the apparatus 100 in emergency conditions, i.e. when the power supply means 40 are no more available and cannot provide electric power for any reason.

Preferably, the power and control unit 1 comprises also a main power drive circuit 14, which is aimed at energising the electro-magnetic actuator 2.

Advantageously, the power drive circuit 14 is electrically fed by the first storage power means 3 and is controlled by the primary control device 11 or even by the secondary control device 12.

Preferably, the power and control unit 1 comprises a power supply circuit 13, which provides electric power to the primary control device 11 and to the secondary control device 12.

The power supply circuit 13 is aimed at feeding the control devices 11 and 12 in normal conditions, when the first power storage means 3 can be continuously charged by the power supply means 40.

The primary control device 11 advantageously comprises a microcontroller (not shown), which is aimed at managing the operations of the apparatus 100, when the power supply means 40 are available.

For example, such a microcontroller may manage internal and external diagnostic activities, control the power drive circuit 14 and the operations of the electro-magnetic actuator by means of appropriate algorithms, provide/receive binary commands, communicate with external or internal devices and perform other activities requested during the operating life of the apparatus 100.

When the power supply means 40 are not available anymore, e.g. due to an electrical fault, the primary control device 11 is substantially deactivated in order to reduce power consumption. Nonetheless, even during this deactivation period, the primary control device 11 may still be activated for short periods of time by the secondary control device 12, in case of need.

The secondary control device 12 is instead active when the power supply means 40 are no more available.

Preferably, the secondary control device 12 comprises a microcontroller 127, which is advantageously able to work in low power dissipation conditions, for example providing full performances with an adsorbed current of 0.5 mA (@3V) and remaining in a deep sleep mode with an adsorbed current of few μAs.

In order to save power, the microcontroller 127 is kept in a quiescent mode for most of the time and it is periodically activated to perform some emergency activities, such as, for example, checking the charging status of the first power storage means, regulating its own power supply, receiving emergency commands, controlling/commanding operations of the apparatus 100, exchanging information/commands with the primary control device 11, receiving information on the operating status of the apparatus 100, providing/receiving binary commands, providing visual information related to the operating status of the apparatus and the like.

Preferably, the microcontroller 127 comprises software means for managing the duration of its staying in a quiescent mode.

When the microcontroller is in a quiescent mode, it executes a software procedure that basically performs the countdown of a predefined time period.

When the countdown is over, the microcontroller 127 automatically switches from a quiescent mode to a full performance mode, in which the microcontroller 127 is activated and can perform the emergency activities mentioned above.

When the power supply means 40 are no more available, in order to reduce power consumption, the secondary control device is advantageously able to receive electric power directly from the first power storage means 3, i.e. not through the power supply circuit 13.

To this aim, the secondary control device 12 comprises a power supply circuit that comprises at least a DC/DC converter 121, which is advantageously aimed at converting a first voltage V1 (hundreds of volts), provided by the first power storage means 3, into a second non regulated voltage V2 (few volts) that is remarkably lower than the first voltage V1.

The DC/DC converter 121 preferably comprises a switching section 1210, including a switching device M1 (FIG. 3).

Preferably, the switching device M1 is a depletion power MOSFET that is designed to have low power dissipation during switching operations, in particular during switching transients.

Depletion MOSFETs can be conveniently controlled trough the gate contact, directly using the voltage available at its source contact, without the need of polarisation networks.

Standard enhancement MOSFETs instead require a gate voltage greater than the source voltage to work.

Thus, if M1 comprised an enhancement MOSFET, a polarisation network would need to be arranged, which is continuously powered directly by first power storage means 3.

Therefore the adoption of a depletion MOSFET for M1 (instead of a standard enhancement MOSFET) allows to further reducing the power consumption of the DC/DC converter 121.

The DC/DC converter 121 comprises a driving section 1211, which includes a first driving circuit 1211A, comprising the further switching devices Q1, Q2 and the resistor R3, and a second driving circuit 1211B, comprising the additional switching device M2.

The DC/DC converter 121 comprises also an output section 1212, which includes the diodes D1 and D2 and the inductor L1.

The first driving circuit 1211A and the second driving circuit 1211B of the driving section 1211 are respectively aimed at enabling and disabling the switching operations of the switching device M1.

The driving circuits 1211A and 1211B are operatively connected to the microcontroller 127 that can thus control the operations of the DC/DC converter 121.

The driving section 1211 is advantageously arranged to effectively reduce power consumption in the switching device M1 during transients.

The further switching device Q2 is in fact operatively associated to the switching device M1 in such a way to immediately stop the current flowing in M1, when the microcontroller 127 commands M1 to switch off.

In principle, the anode of D2 might be connected directly to the source contact of M1; but in this case, the current accumulated in L1 would continue to circulate trough M1 and D2 for sometime after M1 is switched off, resulting in an undesired high power dissipation in M1 during this transient.

The secondary control device 12 preferably comprises second power storage means 122, which advantageously comprise a capacitor C2.

The second power storage means 122 are electrically connected with the output section 1212 of the DC/DC converter 121.

In this manner, the second power storage means 122 can be electrically charged by the first power storage means 3, when the DC/DC converter is activated.

For power saving purposes, the second power storage means 122 are not continuously charged by the first power storage means 3 but only when their charge is under a predefined threshold.

Preferably, the secondary control device 12 comprises a first sensing circuit 124, which is aimed at detecting the first voltage V1 provided by the first power storage means 3.

The first sensing circuit 124 comprises advantageously a partitioning circuit that includes the resistors R1 and R2 arranged in parallel with the first power storage means 3.

The first sensing circuit 124 is operatively connected to the microcontroller 127 and it is activated when the switching section 1210 is activated.

Therefore, information related to the charging status of the first power storage means 3 is conveniently acquired by the microcontroller 127 only when the switching section 1210 is working.

In this manner, power dissipation at the resistors R1 and R2 is reduced.

Preferably, the secondary control device 12 comprises also a second sensing circuit 125, which is aimed at detecting the second voltage V2 provided by the second power storage means 122.

The second sensing circuit 125 comprises advantageously a partitioning circuit 125A, which includes the resistors R4 and R5, arranged in parallel with the second power storage means 122, and an enabling circuit 125B, including the switching devices Q3 and Q4 and the resistor R6.

The enabling circuit 125B enables the passage of current through the resistors R4 and R5 thereby enabling the partitioning circuit 125A to sense the voltage V2.

Both the circuits 125A and 125B are operatively connected to the microcontroller 127, which can thus selectively activate the measurement of the voltage V2.

In this manner, the total amount power dissipated by the resistors R4 and R5 is reduced.

Preferably, the secondary control device 12 comprises a local HMI (Human Machine Interface) 126, which can display information concerning the operating status of the apparatus 100.

Preferably, the HMI 126 comprises a bistable display that is able to maintain the last visualised pieces of information for an indefinite time, even no power supply is provided at all.

The microcontroller 127 advantageously controls also the local HMI 126 thereby providing the display of information related to the operating status of the apparatus 100.

Preferably, the secondary control device 12 comprises a linear regulator 123, which is electrically connected between the second power storage means 122 and the microcontroller 127.

The regulator 123 is advantageously aimed at converting the second voltage V2, which is provided by the second power storage means 122, into a third regulated voltage V3 (typically 3V) that is used to feed the microcontroller 126 and advantageously the local HMI 126.

The regulator 123 is normally active. Preferably, it comprises a low power device that adsorbs a small quiescent current (e.g. few μAs).

From the specification above, it can be appreciated how the secondary control device 12 is arranged to be specifically dedicated to manage the operations of the apparatus 100, when the power supply means 40 are not available and therefore power saving is a mandatory requirement.

When the apparatus 100 operates in normal conditions, the secondary control device 12 does not basically work even if it can be activated by the primary control device 11, in case of need.

When the apparatus 100 operates in emergency conditions, the secondary control device 12 becomes active.

In order to save power, it basically stays a quiescent mode for most of the time and it is operative on a periodic base (e.g. 1 s), for example thanks to a software timer of the microcontroller 127, or in case of need.

This allows to remarkably reducing the total amount power that is drawn from the first power storage means 3.

When it is operative, the microcontroller 127 may activate the switching section 1210 and check the charging status of the first power storage means 3 by means of the first sensing circuit 124.

If the stored power is below a predefined threshold, the microcontroller 127 may activate the primary control device 11 in order to send a command to the power drive circuit 14 to perform an opening operation of the apparatus 100.

As an alternative, the microcontroller 127 may itself send an opening command to the power drive circuit 14.

When it is operative, the microcontroller 127 may also check the charging status of the second power storage means 122 by activating the partitioning circuit 125A through the enabling circuit 125B.

If the voltage V2 is below a certain threshold, such as 4V, the microcontroller enables the DC/DC converter 121 for a short time, e.g. 20 μs.

In this manner, the second power storage means 122 can be charged by the first power storage means 3.

During the period in which the DC/DC converter 121 works, a certain dissipation of power is present, particularly at the driving circuit 1211 and at the switching section 1210.

In any case, since the working period of the DC/DC converter 121 is quite short, the total amount of dissipated power will be relatively low.

Of course, when it is operative, the microcontroller 127 may also perform some of management activities foreseen when the apparatus 100 is in emergency conditions, such as receiving/providing operating commands, exchanging information/commands with the primary control device 11, receiving information on the operating status of the apparatus 100, providing/receiving binary commands, providing visual information on the operating status of the apparatus 100 through the local HMI 126 and the like.

In alternative embodiment (FIG. 4), the power and control unit does not comprise the main power supply circuit 13, which feeds the control devices 11 and 12 in normal conditions.

In this case, the power supply circuit of the secondary control device 12 is advantageously arranged to provide electric power to both the primary control device and the secondary control device 12 in normal conditions.

Preferably, said power supply circuit comprises a switch 15 electrically connected to the DC/DC converter 121.

The switch 15 is advantageously aimed at deactivating the primary control device 11 in emergency conditions, when the power supply means 40 are no more available.

From the specification above, it is apparent how a further aspect of the present invention related to a power supply circuit, which comprises arrangements specifically designed to reduce power dissipation.

Said power supply circuit comprises a DC/DC converter 121, which is electrically connected with a power source 3 in order to convert a first voltage V1, provided by the power source 3, into a second voltage V2 that is lower than the first voltage V1.

The DC/DC converter comprises a switching section 1210 that includes a switching device M1, a driving section 1211 and an output section 1212.

The driving section 1211 comprises at least a further switching device Q2 that is operatively associated to the switching device M1 in such a way to immediately stop the current flowing in the switching device M1, when the switching device M1 is commanded to switch off.

Such a power supply circuit is therefore particularly suitable for use in power and control units, in which power consumption reduction is a mandatory requirement.

It is apparent from the above that the power and control unit 1 of the invention have a number of advantages with respect to similar units of known type.

The power and control unit 1 provides improved performances in terms of power saving when the normal power supply of the apparatus 100 is no more available.

This allows to remarkably extending the period of time in which the apparatus 100 can still be operated in emergency conditions.

The power and control unit 1 allows the apparatus 100 to always be operated in safe manner. In the worst case, when the auxiliary power supply is no more available and the power stored in the first power storage means 3 is under a certain safety threshold, the apparatus 100 is operated so as to assume a safe terminal condition, with the electric contacts separated.

As it can be appreciated from the cited figures, the power and control unit 1 has a relatively simple circuit structure, which can be easily manufactured and at competitive costs.

The power and control unit 1 of the invention finds convenient application in low and medium voltage apparatuses (e.g., circuit breakers, contactors, disconnectors, and similar), which are also to be considered as part of the present invention.

The invention claimed is:

1. A power and control unit for a low or medium voltage apparatus, said apparatus at least a couple of electrical contacts that can be coupled/separated by means of an electro-magnetic actuator, a first power storage means within a main power supply circuit for supplying electric power for the operations of said apparatus and power supply means for charging first said power storage means, said power and control unit comprising:

a primary control device for managing the operations of said apparatus when said power supply means are available, the primary control device drawing operating power from the first power storage means of the main power supply circuit;

a secondary control device for managing the operations of said apparatus when said power supply means are not available, said secondary control device being able to receive electric power directly from said first power storage means, said secondary control device comprising:

a backup power supply circuit comprising at least a DC/DC converter, which is electrically connected with said first power storage means in order to convert a first voltage, provided by said first power storage means, into a second voltage that is lower than said first voltage, and provides electric power to the primary control device and the secondary control device when the power supply means is unavailable;

the second control device remaining in a quiescent state except for periodically checking for and responding to instructions and emergency conditions;

wherein said power and control unit comprises a main power drive circuit to energize said electro-magnetic actuator, said main power drive circuit being fed by said first power storage means and being controlled by said first primary control device or by said secondary control device.

2. A power and control unit, according to claim 1, wherein said secondary control device comprises second power storage means, which are electrically connected to said DC/DC converter, so that said second power storage means can be electrically charged by said first power storage means.

3. A power and control unit, according to claim 1, wherein said secondary control device comprises a microcontroller, which receives electric power from said second power storage means.

4. A power and control unit, according to claim 1, wherein said DC/DC converter is controlled by said microcontroller.

5. A power and control unit, according to claim 1, wherein said secondary control device comprises a linear regulator, which is electrically connected between said second power storage means and said microcontroller, in order to convert the second voltage, provided by said second DC/DC converter, into a third voltage for electrically supplying said microcontroller.

6. A power and control unit, according claim 1, wherein said secondary control device comprises a first sensing circuit to detect the first voltage-provided by said first power storage means.

7. A power and control unit, according to claim 1, wherein said secondary control device comprises a second sensing circuit to detect the second voltage provided by said first power storage means.

8. A power and control unit, according to claim 1, wherein said second sensing circuit is activated by said microcontroller.

9. A power and control unit, according to claim 1, wherein said secondary control device comprises a local HMI to display information concerning the operating status of said apparatus.

10. A power and control unit, according to claim 9, wherein said local HMI comprises a bistable display.

11. A power and control unit, according to claim 1, wherein said power supply circuit comprising a switch to deactivate said primary control device, when said power supply means are not available.

12. A power and control unit, according to claim 1, wherein the main power supply circuit, which provides electric power to the primary control device and to the secondary control device.

13. A power and control unit, according to claim 1, wherein said power supply means comprise manual power charging means and/or an auxiliary power supply electrically connected to the mains.

14. The power and control unit of claim 1, further comprising a power supply circuit comprising a DC/DC converter, which is electrically connected with a power source in order to convert a first voltage, provided by said power source, into a second voltage that is lower than said first voltage, said DC/DC converter comprising a switching section that includes a switching device, a driving section and an output section, said driving section comprising at least a further switching device that is operatively associated to said switching device, so as to immediately stop the current flowing in said switching device, when said switching device is commanded to switch off.

15. A power and control unit, according to claim 1, wherein said secondary control device comprises second power storage means, which are electrically connected to said DC/DC converter, so that said second power storage means can be electrically charged by said first power storage means.

16. A power and control unit, according to claim 1, wherein said secondary control device comprises a microcontroller, which receives electric power from said second power storage means.

17. A power and control unit, according to claim 2, wherein said secondary control device comprises a microcontroller, which receives electric power from said second power storage means.

18. A power and control unit, according to claim 1, wherein said DC/DC converter is controlled by said microcontroller.

19. A power and control unit, according to claim 2, wherein said DC/DC converter is controlled by said microcontroller.

* * * * *